US009217319B2

(12) United States Patent
Frazier et al.

(10) Patent No.: US 9,217,319 B2
(45) Date of Patent: Dec. 22, 2015

(54) HIGH-MOLECULAR-WEIGHT POLYGLYCOLIDES FOR HYDROCARBON RECOVERY

(71) Applicant: Frazier Technologies, L.L.C., Corpus Christi, TX (US)

(72) Inventors: W. Lynn Frazier, Corpus Christi, TX (US); Garrett Frazier, Corpus Christi, TX (US); Derrick Frazier, Corpus Christi, TX (US)

( * ) Notice: Subject to any disclaimer, the term of this patent is extended or adjusted under 35 U.S.C. 154(b) by 268 days.

(21) Appl. No.: 13/894,649

(22) Filed: May 15, 2013

(65) Prior Publication Data

US 2014/0083717 A1 Mar. 27, 2014

Related U.S. Application Data

(63) Continuation of application No. 13/843,051, filed on Mar. 15, 2013, now abandoned.

(60) Provisional application No. 61/648,749, filed on May 18, 2012, provisional application No. 61/738,519, filed on Dec. 18, 2012.

(51) Int. Cl.

| | |
|---|---|
| ***E21B 29/02*** | (2006.01) |
| ***E21B 33/134*** | (2006.01) |
| ***E21B 43/26*** | (2006.01) |
| ***E21B 33/12*** | (2006.01) |
| ***E21B 34/06*** | (2006.01) |

(52) U.S. Cl.

CPC ..... *E21B 43/26* (2013.01); *E21B 33/12* (2013.01); *E21B 33/134* (2013.01); *E21B 34/063* (2013.01)

(58) Field of Classification Search

CPC ... E21B 29/02; E21B 33/1208; E21B 33/134; E21B 34/063; E21B 43/26

See application file for complete search history.

(56) References Cited

U.S. PATENT DOCUMENTS

| | | | |
|---|---|---|---|
| 2,040,889 | A | 5/1936 | Whinnen |
| 2,160,228 | A | 5/1939 | Pustmueller |
| 2,223,602 | A | 12/1940 | Cox |
| 2,230,447 | A | 2/1941 | Bassinger |
| 2,286,126 | A | 6/1942 | Thornhill |
| 2,331,532 | A | 10/1943 | Bassinger |
| 2,555,627 | A | 6/1951 | Baker |
| 2,589,506 | A | 3/1952 | Morrisett |
| 2,593,520 | A | 4/1952 | Baker |
| 2,616,502 | A | 11/1952 | Lenz |
| 2,640,546 | A | 6/1953 | Baker |
| 2,713,910 | A | 7/1955 | Baker |
| 2,833,354 | A | 5/1956 | Sailers |
| 2,830,666 | A | 4/1958 | Rhodes |
| 3,013,612 | A | 12/1961 | Angel |
| 3,054,453 | A | 9/1962 | Bonner |
| 3,062,296 | A | 11/1962 | Brown |
| 3,163,225 | A | 12/1964 | Perkins |
| 3,273,588 | A | 9/1966 | Dollison |
| 3,298,437 | A | 1/1967 | Conrad |

(Continued)

FOREIGN PATENT DOCUMENTS

| | | |
|---|---|---|
| GB | 914030 | 12/1962 |
| WO | 2010127457 | 11/2010 |

*Primary Examiner* — Catherine Loikith

(57) ABSTRACT

A tool having a high-molecular weight Polyglycolides such as polyglycolic acid (PGA) may be used in downhole hydrocarbon recovery applications. Advantageously, PGA tools do not need to be drilled out but will naturally break down into environmentally-compatible natural compounds.

9 Claims, 16 Drawing Sheets

(56) References Cited

U.S. PATENT DOCUMENTS

| | | | |
|---|---|---|---|
| 3,298,440 | A | 1/1967 | Current |
| 3,306,362 | A | 2/1967 | Urbanosky |
| 3,308,895 | A | 3/1967 | Oxford |
| 3,356,140 | A | 12/1967 | Young |
| 3,517,742 | A | 6/1970 | Williams |
| 3,623,551 | A | 11/1971 | Randermann |
| 3,687,202 | A | 8/1972 | Young |
| 3,787,101 | A | 1/1974 | Sugden |
| 3,818,987 | A | 6/1974 | Ellis |
| 3,851,706 | A | 12/1974 | Ellis |
| 3,860,066 | A | 1/1975 | Pearce |
| 3,926,253 | A | 12/1975 | Duke |
| 4,035,024 | A | 7/1977 | Fink |
| 4,049,015 | A | 9/1977 | Brown |
| 4,134,455 | A | 1/1979 | Read |
| 4,151,875 | A | 5/1979 | Sullaway |
| 4,185,689 | A | 1/1980 | Harris |
| 4,189,183 | A | 2/1980 | Borowski |
| 4,250,960 | A | 2/1981 | Chammas |
| 4,314,608 | A | 2/1982 | Richardson |
| 4,381,038 | A | 4/1983 | Sugden |
| 4,391,547 | A | 7/1983 | Jackson |
| 4,405,017 | A | 9/1983 | Allen |
| 4,432,418 | A | 2/1984 | Mayland |
| 4,436,151 | A | 3/1984 | Callihan |
| 4,457,376 | A | 7/1984 | Carmody |
| 4,532,995 | A | 8/1985 | Kaufman |
| 4,548,442 | A | 10/1985 | Sugden |
| 4,554,981 | A | 11/1985 | Davies |
| 4,566,541 | A | 1/1986 | Moussy |
| 4,585,067 | A | 4/1986 | Blizzard |
| 4,595,052 | A | 6/1986 | Kristiansen |
| 4,602,654 | A | 7/1986 | Stehling |
| 4,688,641 | A | 8/1987 | Knieriemen |
| 4,708,163 | A | 11/1987 | Deaton |
| D293,798 | S | 1/1988 | Johnson |
| 4,776,410 | A | 10/1988 | Perkin |
| 4,784,226 | A | 11/1988 | Wyatt |
| 4,792,000 | A | 12/1988 | Perkin |
| 4,830,103 | A | 5/1989 | Blackwell |
| 4,848,459 | A | 7/1989 | Blackwell |
| 4,893,678 | A | 1/1990 | Stokley |
| 5,020,590 | A | 6/1991 | McLeod |
| 5,074,063 | A | 12/1991 | Vannette |
| 5,082,061 | A | 1/1992 | Dollison |
| 5,095,980 | A | 3/1992 | Watson |
| 5,113,940 | A | 5/1992 | Glaser |
| 5,117,915 | A | 6/1992 | Mueller |
| 5,154,228 | A | 10/1992 | Gambertoglio |
| 5,183,068 | A | 2/1993 | Prosser |
| 5,188,182 | A | 2/1993 | Echols |
| 5,207,274 | A | 5/1993 | Streich |
| 5,209,310 | A | 5/1993 | Clydesdale |
| 5,219,380 | A | 6/1993 | Young |
| 5,230,390 | A | 7/1993 | Zastresek |
| 5,234,052 | A | 8/1993 | Coone |
| 5,253,705 | A | 10/1993 | Clary |
| 5,295,735 | A | 3/1994 | Cobbs |
| 5,316,081 | A | 5/1994 | Baski |
| 5,318,131 | A | 6/1994 | Baker |
| D350,887 | S | 9/1994 | Sjolander |
| 5,343,954 | A | 9/1994 | Bohlen |
| D353,756 | S | 12/1994 | Graves |
| D355,428 | S | 2/1995 | Hatcher |
| 5,390,737 | A | 2/1995 | Jacobi |
| 5,392,540 | A | 2/1995 | Cooper |
| RE35,088 | E | 11/1995 | Gilbert |
| 5,484,191 | A | 1/1996 | Sollami |
| 5,490,339 | A | 2/1996 | Accettola |
| 5,540,279 | A | 7/1996 | Branch |
| 5,564,502 | A | 10/1996 | Crow |
| 5,593,292 | A | 1/1997 | Ivey |
| D377,969 | S | 2/1997 | Grantham |
| 5,655,614 | A | 8/1997 | Azar |
| 5,701,959 | A | 12/1997 | Hushbeck |
| 5,785,135 | A | 7/1998 | Crawley |
| 5,791,825 | A | 8/1998 | Gardner |
| 5,803,173 | A | 9/1998 | Fraser |
| 5,810,083 | A | 9/1998 | Kilgore |
| 5,819,846 | A | 10/1998 | Bolt |
| D415,180 | S | 10/1999 | Rosanwo |
| 5,961,185 | A | 10/1999 | Friant |
| 5,984,007 | A | 11/1999 | Yuan |
| 5,988,277 | A | 11/1999 | Vick |
| 6,012,519 | A | 1/2000 | Allen |
| 6,085,446 | A | 7/2000 | Posch |
| 6,098,716 | A | 8/2000 | Hromas |
| 6,105,694 | A | 8/2000 | Scott |
| RE17,217 | E | 10/2000 | Burch |
| 6,142,226 | A | 11/2000 | Vick |
| 6,152,232 | A | 11/2000 | Webb |
| 6,167,963 | B1 | 1/2001 | McMahan |
| 6,182,752 | B1 | 2/2001 | Smith |
| 6,189,618 | B1 | 2/2001 | Beeman |
| 6,199,636 | B1 | 3/2001 | Harrison |
| 6,220,349 | B1 | 4/2001 | Vargus |
| 6,283,148 | B1 | 9/2001 | Spears |
| 6,341,823 | B1 | 1/2002 | Sollami |
| 6,367,569 | B1 | 4/2002 | Walk |
| 6,394,180 | B1 | 5/2002 | Berscheidt |
| 6,457,267 | B1 | 10/2002 | Porter |
| 6,491,108 | B1 | 12/2002 | Slup |
| 6,543,963 | B2 | 4/2003 | Bruso |
| 6,581,681 | B1 | 6/2003 | Zimmerman |
| 6,629,563 | B2 | 10/2003 | Doane |
| 6,695,049 | B2 | 2/2004 | Ostocke |
| 6,725,935 | B2 | 4/2004 | Szarka |
| 6,739,398 | B1 | 5/2004 | Yokley |
| 6,779,948 | B2 | 8/2004 | Bruso |
| 6,799,633 | B2 | 10/2004 | McGregor |
| 6,834,717 | B2 | 12/2004 | Bland |
| 6,851,489 | B2 | 2/2005 | Hinds |
| 6,854,201 | B1 | 2/2005 | Hunter |
| 6,902,006 | B2 | 6/2005 | Myerley |
| 6,918,439 | B2 | 7/2005 | Dallas |
| 6,938,696 | B2 | 9/2005 | Dallas |
| 6,944,977 | B2 | 9/2005 | Deniau |
| 7,040,410 | B2 | 5/2006 | McGuire |
| 7,055,632 | B2 | 6/2006 | Dallas |
| 7,069,997 | B2 | 7/2006 | Coyes |
| 7,107,875 | B2 | 9/2006 | Haugen |
| 7,124,831 | B2 | 10/2006 | Turley |
| 7,128,091 | B2 | 10/2006 | Istre |
| 7,134,505 | B2 | 11/2006 | Fehr |
| 7,150,131 | B2 | 12/2006 | Barker |
| 7,168,494 | B2 | 1/2007 | Starr |
| 7,281,584 | B2 | 10/2007 | McGarian |
| D560,109 | S | 1/2008 | Huang |
| 7,325,617 | B2 | 2/2008 | Murray |
| 7,337,847 | B2 | 3/2008 | McGarian |
| 7,353,879 | B2 | 4/2008 | Todd |
| 7,363,967 | B2 | 4/2008 | Burris |
| 7,373,973 | B2 | 5/2008 | Smith |
| 7,464,764 | B2 | 12/2008 | Xu |
| 7,527,104 | B2 | 5/2009 | Branch |
| 7,552,779 | B2 | 6/2009 | Murray |
| D579,110 | S | 7/2009 | Antua |
| 7,600,572 | B2 | 10/2009 | Slup |
| 7,604,058 | B2 | 10/2009 | McGuire |
| 7,637,326 | B2 | 12/2009 | Bolding |
| 7,644,767 | B2 | 1/2010 | Kalb |
| 7,644,772 | B2 | 1/2010 | Avant |
| 7,644,774 | B2 | 1/2010 | Branch |
| 7,647,964 | B2 | 1/2010 | Akbar |
| D612,875 | S | 3/2010 | Beynon |
| 7,673,677 | B2 | 3/2010 | King |
| 7,681,645 | B2 | 3/2010 | McMillin |
| D618,715 | S | 6/2010 | Corcoran |
| 7,735,549 | B1 | 6/2010 | Nish |
| 7,775,278 | B2 * | 8/2010 | Willberg et al. ..... 166/280.1 |
| 7,775,286 | B2 | 8/2010 | Duphorne |
| 7,775,291 | B2 | 8/2010 | Jacob |
| 7,784,550 | B2 | 8/2010 | Nutley |
| 7,798,236 | B2 | 9/2010 | McKeachnie |

(56) References Cited

U.S. PATENT DOCUMENTS

| | | | | |
|---|---|---|---|---|
| 7,810,558 | B2 | 10/2010 | Shkurti | |
| D629,820 | S | 12/2010 | Van Ryswyk | |
| 7,866,396 | B2 | 1/2011 | Rytlewski | |
| 7,878,242 | B2 | 2/2011 | Gray | |
| 7,886,830 | B2 | 2/2011 | Bolding | |
| 7,900,696 | B1 | 3/2011 | Nish | |
| 7,909,108 | B2 | 3/2011 | Swor | |
| 7,909,109 | B2 | 3/2011 | Angman | |
| D635,429 | S | 4/2011 | Hakki | |
| 7,918,278 | B2 | 4/2011 | Barbee | |
| 7,921,923 | B2 | 4/2011 | McGuire | |
| 7,921,925 | B2 | 4/2011 | Maguire et al. | |
| 7,926,571 | B2 | 4/2011 | Hofman | |
| 8,074,718 | B2 | 12/2011 | Roberts | |
| 8,079,413 | B2 | 12/2011 | Frazier | |
| 8,113,276 | B2 | 2/2012 | Greenlee | |
| 8,127,856 | B1 | 3/2012 | Nish | |
| D657,807 | S | 4/2012 | Frazier | |
| 8,231,947 | B2 | 7/2012 | Vaidya | |
| 2001/0040035 | A1 | 11/2001 | Appleton | |
| 2003/0024706 | A1 | 2/2003 | Allamon | |
| 2003/0188860 | A1 | 10/2003 | Zimmerman | |
| 2004/0150533 | A1 | 8/2004 | Hall | |
| 2005/0173126 | A1 | 8/2005 | Starrt | |
| 2006/0001283 | A1 | 1/2006 | Bakke | |
| 2006/0011389 | A1 | 1/2006 | Booth | |
| 2006/0278405 | A1 | 12/2006 | Turley | |
| 2007/0051521 | A1 | 3/2007 | Fike | |
| 2007/0068670 | A1 | 3/2007 | Booth | |
| 2007/0107908 | A1 | 5/2007 | Vaidya | |
| 2007/0227745 | A1 | 10/2007 | Roberts | |
| 2007/0240883 | A1 | 10/2007 | Telfer | |
| 2008/0110635 | A1 | 5/2008 | Loretz | |
| 2009/0044957 | A1 | 2/2009 | Clayton | |
| 2009/0114401 | A1 | 5/2009 | Purkis | |
| 2009/0126933 | A1 | 5/2009 | Telfer | |
| 2009/0211749 | A1 | 8/2009 | Nguyen | |
| 2010/0064859 | A1 | 3/2010 | Stephens | |
| 2010/0084146 | A1 | 4/2010 | Roberts | |
| 2010/0101803 | A1 | 4/2010 | Clayton et al. | |
| 2010/0132960 | A1 | 6/2010 | Shkurti | |
| 2010/0155050 | A1 | 6/2010 | Frazier | |
| 2010/0252252 | A1 | 10/2010 | Harris | |
| 2010/0276159 | A1 | 11/2010 | Mailand | |
| 2010/0288503 | A1 | 11/2010 | Cuiper | |
| 2011/0005779 | A1 | 1/2011 | Lembcke | |
| 2011/0036564 | A1 | 2/2011 | Williamson | |
| 2011/0061856 | A1 | 3/2011 | Kellner | |
| 2011/0088915 | A1 | 4/2011 | Stanojcic | |
| 2011/0103915 | A1 | 5/2011 | Tedeschi | |
| 2011/0147014 | A1* | 6/2011 | Chen et al. | 166/387 |
| 2011/0168404 | A1 | 7/2011 | Telfer | |
| 2011/0198082 | A1 | 8/2011 | Stromquist | |
| 2011/0240295 | A1 | 10/2011 | Porter | |
| 2011/0259610 | A1 | 10/2011 | Shkurti | |
| 2012/0073819 | A1* | 3/2012 | Richard et al. | 166/308.1 |
| 2013/0008666 | A1 | 1/2013 | Cherewyk | |
| 2013/0008671 | A1 | 1/2013 | Booth | |
| 2013/0014936 | A1 | 1/2013 | Griffith | |
| 2013/0068474 | A1 | 3/2013 | Hofman et al. | |
| 2013/0300066 | A1 | 11/2013 | Xu et al. | |
| 2013/0306327 | A1 | 11/2013 | Williamson | |
| 2013/0319668 | A1 | 12/2013 | Tschetter et al. | |
| 2013/0319682 | A1 | 12/2013 | Tschetter et al. | |
| 2013/0333891 | A1 | 12/2013 | Fripp et al. | |
| 2014/0000894 | A1 | 1/2014 | Coffey et al. | |
| 2014/0020911 | A1 | 1/2014 | Martinez | |
| 2014/0027128 | A1 | 1/2014 | Johnson et al. | |
| 2014/0041857 | A1 | 2/2014 | Xu et al. | |
| 2014/0060813 | A1 | 3/2014 | Naedler et al. | |
| 2014/0096970 | A1 | 4/2014 | Andrew et al. | |
| 2014/0102709 | A1 | 4/2014 | Arabskyy | |
| 2014/0116677 | A1 | 5/2014 | Sherlin | |
| 2014/0116721 | A1 | 5/2014 | Hofman et al. | |
| 2014/0116731 | A1 | 5/2014 | Themig et al. | |
| 2014/0116775 | A1 | 5/2014 | Coffey et al. | |
| 2014/0182862 | A1 | 7/2014 | Derby | |
| 2014/0196899 | A1 | 7/2014 | Jordan et al. | |
| 2014/0224476 | A1 | 8/2014 | Frazier | |
| 2014/0224477 | A1 | 8/2014 | Wiese et al. | |
| 2014/0231069 | A1 | 8/2014 | VanLue | |
| 2014/0231099 | A1 | 8/2014 | Barbee et al. | |
| 2014/0246189 | A1 | 9/2014 | Beason et al. | |
| 2014/0246208 | A1 | 9/2014 | Themig et al. | |
| 2014/0248448 | A1 | 9/2014 | Sjostedt | |
| 2014/0251594 | A1 | 9/2014 | Garcia et al. | |
| 2014/0251612 | A1 | 9/2014 | Powers | |
| 2014/0251636 | A1 | 9/2014 | Hofman et al. | |

* cited by examiner

MECHANICAL SET CEMENT RETAINER WITH SLIDING SLEEVE CHECK VALVE
400

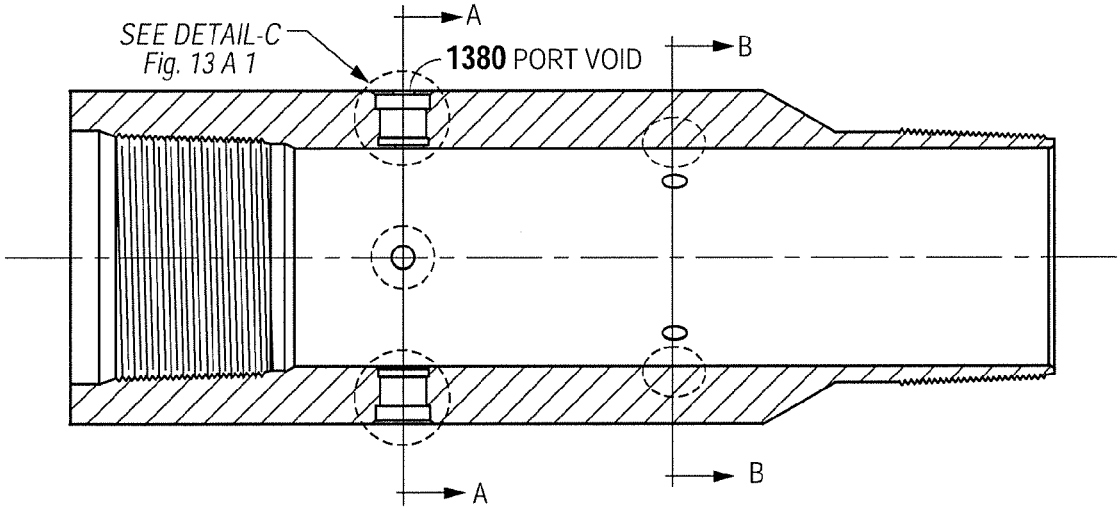
Fig. 13 A
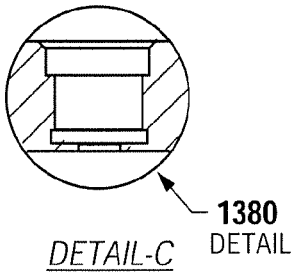
Fig. 13 A 1
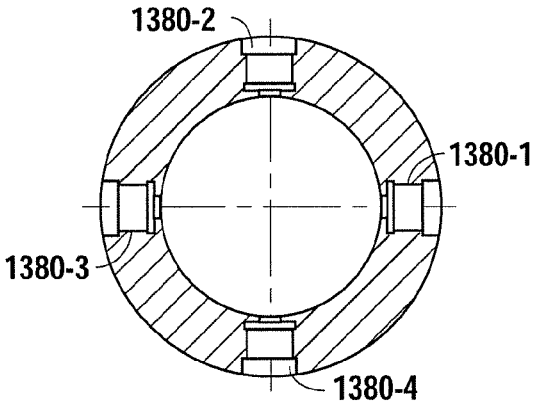
SECTION A-A
Fig. 13 A2
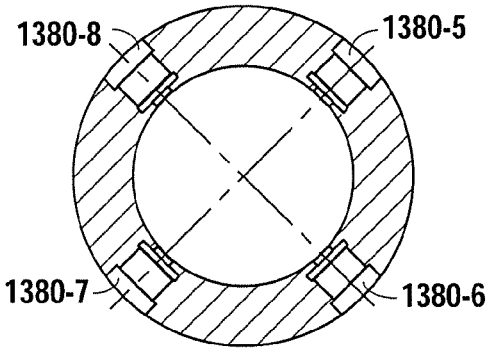
SECTION B-B
Fig. 13 A3

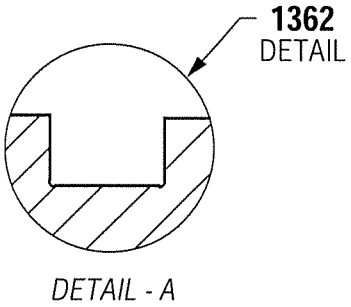
Fig. 13B1
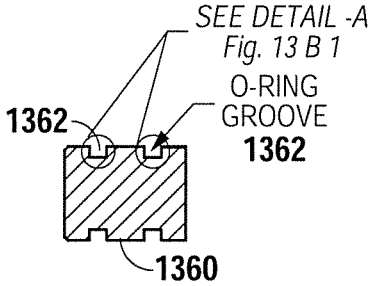
Fig. 13B
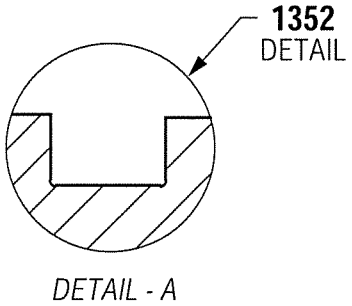
Fig. 13C2
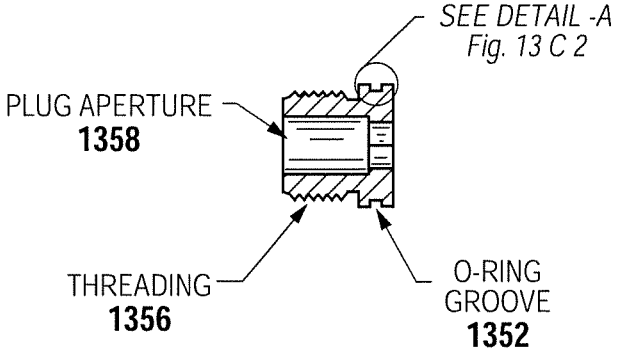
Fig. 13C
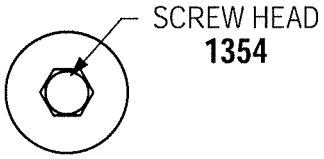
Fig. 13C1

HIGH-MOLECULAR-WEIGHT POLYGLYCOLIDES FOR HYDROCARBON RECOVERY

CROSS REFERENCE TO RELATED APPLICATIONS

This application claims priority to U.S. patent application Ser. No. 13/843,051, filed Mar. 15, 2013; U.S. Provisional Application 61/648,749, filed May 18, 2012; U.S. Provisional Application 61/738,519, filed Dec. 18, 2012; and US Patent Publication No. 2010/0155050, published Jun. 24, 2010, all of which are incorporated herein by reference.

U.S. Pat. No. 6,951,956 is also incorporated herein by reference.

BACKGROUND OF THE INVENTION

This specification relates to the field of mineral and hydrocarbon recovery, and more particularly to the use of high-molecular weight polyglycolic acid as a primary structural member for a dissolvable oilfield tool.

It is well known in the art that certain geological formations have hydrocarbons, including oil and natural gas, trapped inside of them that are not efficiently recoverable in their native form. Hydraulic fracturing ("fracking" for short) is a process used to fracture and partially collapse structures so that economic quantities of minerals and hydrocarbons can be recovered. The formation may be divided into zones, which are sequentially isolated, exposed, and fractured. Fracking fluid is driven into the formation, causing additional fractures and permitting hydrocarbons to flow freely out of the formation.

It is also known to create pilot perforations and pump acid through the pilot perforations into the formation, thereby dissolving the formation and allowing the hydrocarbons to migrate to the larger formed fractures or fissure.

To frac multiple zones, untreated zones must be isolated from already-treated zones so that hydraulic pressure fractures the new zones instead of merely disrupting the already-fracked zones. There are many known methods for isolating zones, including the use of a frac sleeve, which includes a mechanically-actuated sliding sleeve engaged by a ball seat. A plurality of frac sleeves may be inserted into the well. The frac sleeves may have progressively smaller ball seats. The smallest frac ball is inserted first, passing through all but the last frac sleeve, where it seats. Applied pressure from the surface causes the frac ball to press against the ball seat, which mechanically engages a sliding sleeve. The pressure causes the sleeve to mechanically shift, opening a plurality of frac ports and exposing the formation. High-pressure fracking fluid is injected from the surface, forcing the frac fluid into the formation, and the zone is fracked.

After that zone is fracked, the second-smallest frac ball is pumped into the well bore, and seats in the penultimate sleeve. That zone is fracked, and the process is continued with increasingly larger frac balls, the largest ball being inserted last. After all zones are fracked, the pumpdown back pressure may move frac balls off seat, so that hydrocarbons can flow to the surface. In some cases, it is necessary to mill out the frac ball and ball seat, for example if back pressure is insufficient or if the ball was deformed by the applied pressure.

It is known in the prior art to manufacture frac balls out of carbon, composites, metals, and synthetic materials such as nylon. When the frac ball has filled its purpose, it must either naturally flow of the well, or it must be destructively drilled out. Baker Hughes is also known to provide a frac ball constructed of a nanocomposite material known as "In-Tallic." In-Tallic balls are advertised to begin dissolving within 100 hours in a potassium chloride solution.

Another style of frac ball can be pumped to a different style of ball seat, engaging sliding sleeves. The sliding sleeves open as pressure is increased, causing the sleeves to overcome a shearing mechanism, sliding the sleeve open, in turn exposing ports or slots behind the sleeves. This permits the ports or slots to act as a conduit into the formation for hydraulic fracturing, acidizing or stimulating the formation

SUMMARY OF THE INVENTION

In one exemplary embodiment, a plurality of mechanical tools for downhole use are described, each comprising substantial structural elements made with high molecular weight polyglycolic acid (PGA). The PGA material of the present disclosure loses crystalline structure under thermal stresses of at least approximately 250° F. within approximately 48 hours. After the crystalline structure breaks down, the material can be safely left to biodegrade over a period of several months. The products of biodegradation is naturally-occurring glycine within approximately 48 hours. After the crystalline structure breaks down, the material can be safely left to biodegrade over a period of several months. The products of biodegradation is naturally-occurring glycine within approximately 48 hours. After the crystalline structure breaks down, the material can be safely left to biodegrade over a period of several months. The products of biodegradation is naturally-occurring glycine within approximately 48 hours. After the crystalline structure breaks down, the material can be safely left to biodegrade over a period of several months. The products of biodegradation is naturally-occurring glycine.

BRIEF DESCRIPTION OF THE DRAWINGS

FIG. 13A is a full cutaway view of an exemplary embodiment of a balldrop isolation sub with PGA retaining plugs.

FIG. 13A1 is a detailed view of the port void designated "DETAIL-C" in FIG. 13A.

FIG. 13A2 is a cross-section view of the plug voids of the isolation sub of FIG. 13A along reference lines A-A showing the position of a course of plug voids.

FIG. 13A3 is a cross-section view of the plug voids of the isolation sub of FIG. 13A along reference lines B-B showing the 45° offset position of a second course of plug voids relative to the first course of plug voids.

FIG. 13B is a detailed side view of a PGA plug.

FIG. 13B1 is a detailed view of an O-ring groove in the PGA plug designated "DETAIL-A" in FIG. 13B.

FIG. 13C is a more detailed view of a retaining plug.

FIG. 13C1 is a detailed view of a of a retaining plug's screw head.

FIG. 13C2 is a detailed view of the O-ring groove designated "DETAIL-A" in FIG. 13C.

DETAILED DESCRIPTION OF THE EMBODIMENTS

Figure 1:
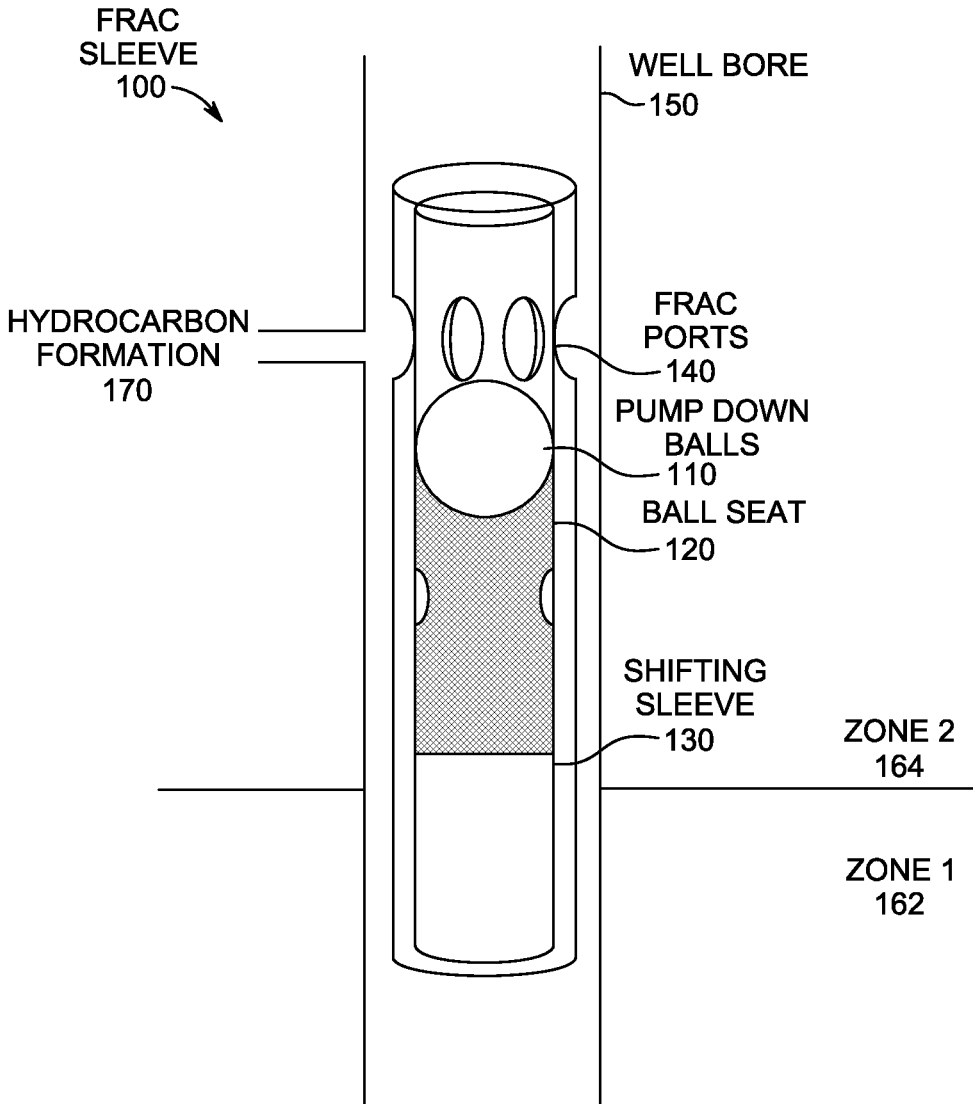
FIG. 1 is a cutaway side view of a frac sleeve actuated with a PGA frac ball.

One concern in the use of frac sleeves with PGA frac balls is that the balls themselves can become problematic. Because it is impossible to see what is going on in a well, if something goes wrong, it is difficult to know exactly what has gone wrong. It is suspected that prior art frac balls can become jammed, deformed, or that they can otherwise obstruct hydrocarbon flow.

One known solution is to mill out the prior art frac balls and the ball seats. But milling is expensive and takes time away from production. Baker Hughes has introduced a nanocomposite frac ball called In-Tallic. In-Tallic balls will begin to dissolve within about 100 hours of insertion into the well, in the presence of potassium chloride. The In-Tallic material is relatively expensive and relatively unavailable.

Kuredux, and in particular Kuredux grade 100R60 is a biodegradable polyester with excellent mechanical properties and processability. Frazier, et al. have identified a method of processing Kuredux into mechanical tools for downhole drilling applications, for example for hydrocarbon and mineral recovery.

Polyglycolic (PGA) acid is a polyester of glycolic acid. PGA is known in the art to biodegrade within approximately 12 months. PGA also been shown to have excellent short-term stability in ambient conditions. For example, the Applicant has tested PGA frac balls of the present disclosure by leaving them in room temperature tap water for months at a time. After two months, the PGA frac balls showed no signs of substantial degradation or structural changes. PGA frac balls also show no sign of degradation in ambient moisture conditions over a period of several months.

In one test of an exemplary embodiment, a 3.375-inch PGA frac ball withstood 6,633 psi before structural failure. A 2.12-inch frac ball withstood 14,189 psi before failing. A 1.5-inch in frac ball with should at least 15,000 psi for 15 minutes without failing A failure point was not reached because the test rig was not able to exceed 15,000 psi. Thus, a PGA frac ball is suitable for high pressure downhole hydrocarbon recovery operations.

Advantageously, PGA frac balls can be pumped down a well bore from the surface. The pumping fluid is approximately 50 to 75° Fahrenheit, which conditions do not have any appreciable effect on the short-term structural integrity of the frac ball. When fracking operations are commenced, however, the temperature rises dramatically. In south Texas oil wells, temperatures range from 250° F. to 400° F. Temperature ranges vary around the world and thus may be higher or lower and other locations. Once the frac ball is exposed to the higher temperature and pressure conditions of the fracking operation, it begins to rapidly lose its crystalline structure. Under testing, a 140 g sample was placed in water at 150F for four days. After four days, the mass had fallen to 120 g. In a second test, a 160 g sample was placed in water at 200° F. for four days. After four days, the mass of the sample had reduced to 130 g. Acids may expedite dissolution. Kureha has provided the following formula for estimating single-sided degradation from thermal stress alone, measured in mm/h.

$$\text{Amm } 0.5e23.654\text{-}9443/K \quad (1)$$

Because these time spans are consistent which the time in which a conventional frac ball would be drilled out, the frac ball can be used without further intervention from the operator. In an exemplary application, a series of frac balls is used in a fracking operation. As the frac balls begin to lose structure, their volumes decrease slightly and they pass through their respective ball seats and move toward the toe of the well bore. Over succeeding hours, the frac balls continue to lose structure until they eventually form a soft mush without appreciable crystalline structure. This material can be left downhole without concern. Over a period of months, the PGA material itself will biodegrade. In one exemplary embodiment, PGA frac balls substantially lose structure within approximately 48 hours in a well with an average temperature of approximately 250° F., and completely biodegrades over several months.

Further advantageously, degradation of PGA is commonly accomplished by random hydrolysis of ester bonds. The breaking of these ester bonds reduces PGA to glycolic acid, an organic substance that is not considered a pollutant and is not generally harmful to the environment or to people. Indeed, glycolic acid is used in many pharmaceutical preparations for absorption into the skin. Glycolic acid may further breakdown into glycine, or carbon dioxide and water. Thus, even in the case of PGA mechanical tools that are ultimately drilled out, the remnants can be safely discarded without causing environmental harm.

Degradation of PGA commonly takes place in two stages. In the first stage, water diffuses into the amorphous regions. In the second stage, the crystalline areas dissolved. Once serious degradation begins, it can progress rapidly. In many cases, a mechanical tool made of PGA will experience sudden mechanical failure at an advantageous time after it has fulfilled its purpose, for example, within approximately 2 days. It is believed that mechanical failure is achieved by the first stage, wherein the crystalline structure is compromised by hydrolysis. The result is PGA particulate matter that otherwise retains its chemical and mechanical properties. Over time, the particulate matter enters the second stage and begins biodegradation proper.

Processing of the PGA material comprises purchasing an appropriate PGA and coliform from a supplier. In one embodiment, Kuredux branded PGA can be purchased from the Kureha Corporation. In an exemplary embodiment, grade 100R60 PGA is purchased from Kureha Corporation through its U.S. supplier, Itochu. Kuredux can be purchased in pellet form. The pellets are then melted down and extruded into bars. In one embodiment, the extruded Kuredux bars are cut and machined into at least 63 different sizes of PGA balls ranging in size from 0.75 inches to 4.625 inches in A-inch increments. The 63 different sizes correspond to matching sliding sleeves that can be laid out in series, so that the smallest ball can be put down into the well first and seat onto the smallest valve. The next smallest ball can be pumped down second and a seat on the second smallest seat, and so forth. These ranges and processing methods are provided by way of example only. PGA frac balls smaller than 0.75 inches or larger than 4.625 inches can be manufactured. In other embodiments, injection molding or thermoforming techniques known in the art may also be used.

In an exemplary embodiment of the present invention, a well bore 150 is drilled into a hydrocarbon formation 170. A frac sleeve 100 has been inserted into well bore 150 to isolate the zone 1 162 from zone 2 164. Zone 1 and zone 2 are conceptual divisions, and are not explicitly delimited except by frac sleeve 100 itself. In an exemplary embodiment, hydrocarbon formation 170 may be divided into 63 or more zones. Zone 1 162 has already been fracked, and now zone 2 164 needs to be fracked. PGA frac ball 110, which has an outer diameter selected to seat securely into ball seat 120 is pumped down into the well bore 150. In some embodiments, frac sleeve 100 forms part of the tubing or casing string.

Frac sleeve 100 includes a shifting sleeve 130, which is mechanically coupled to ball seat 120. Initially, shifting sleeve 130 covers frac ports, 140. When PGA frac ball 110 is seated into ball seat 120 and high-pressure fracking fluid fills well bore 150, shifting sleeve 130 will mechanically shift, moving in a down-hole direction. This shifting exposes frac ports 140, so that there is fluid communication between frac ports 140 and hydrocarbon formation 170. As the pressure of fracking fluid increases, hydrocarbon formation 170 fractures, freeing trapped hydrocarbons from hydrocarbon formation 170.

Frazier, et al., have found that PGA frac balls made of Kuredux will begin to break down in approximately 48 hours in aqueous solution at approximately 250° F. The presence of acids in the water will enhance solubility.

Advantageously, PGA frac balls made of Kuredux have strength similar to metals. This allows them to be used for effective isolation in the extremely high pressure environment of fracking operations. Once the Kuredux balls start to dissolve, they begin to lose their structural integrity, and easily unseat, moving out of the way of hydrocarbon production. Eventually, the balls dissolve completely.

In the previous example, Kuredux PGA frac balls are provided in sizes between 0.75 inches and 4.625 inches, to facilitate operation of frac sleeves of various sizes. In other embodiments, balls may be provided from 1 inch up to over 4 inches. In some applications, ball sizes may be increased in one-eighth inch increments. In other applications, the incremental increase may be in sixteenths of an inch. Thus, in some cases, provision can be made for fracking up to 63 zones with a single run of frac balls.

Furthermore, in some embodiments of a frac sleeve, multiple balls must be pumped into the sleeve to complete the operation. For example, some prior art systems require up to four frac balls to operate a frac sleeve. In those cases, a plurality of identical PGA frac balls 110 may be used.

In an alternative embodiment, a frac ball 110 is pumped down into the wellbore, seated in an independent ball seat at the lower end of the well, and pressure is applied at the surface to volume test the casing. This enables a volume test on the casing without any intervention necessary to remove the frac ball 110, which naturally biodegrades.

Kuredux can also be used to manufacture downhole tools that are designed to be drilled out. For example, a flapper valve, such as is disclosed in U.S. Pat. No. 7,287,596, can be manufactured with Kuredux, so that it can be more easily broken after a zone has been fracked. A composite bridge plug can also be manufactured with Kuredux. This may obviate the need to mill out the bridge plug after fracking, or may make milling out the bridge plug faster and easier.

Kuredux specifically has been disclosed as an exemplary material for use in creating dissolvable PGA frac balls, but it should be understood that any material with similar properties can be used. Furthermore, while the PGA balls in this exemplary embodiment are referred to as "PGA frac balls," those having skill in the art will recognize that such balls have numerous applications, including numerous applications in hydrocarbon recovery, and that the term "PGA frac ball" as used herein is intended to encompass any spherical ball constructed substantially of high-molecular weight polyglycolic acid, and in particular any such ball used in hydrocarbon recovery operations.

Figure 2:
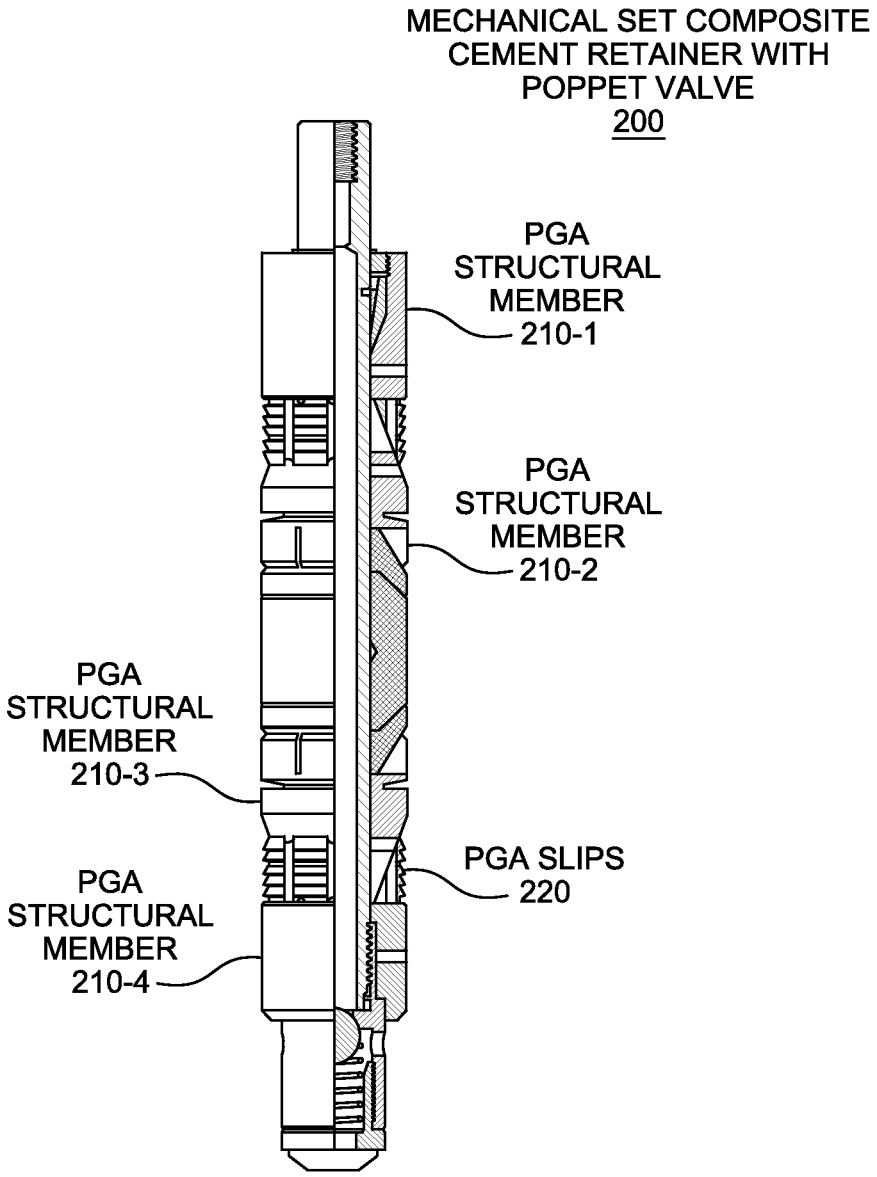
FIG. 2 is a cutaway side view of a mechanical set composite cement retainer with poppet valve, having PGA structural members.

FIG. 2 is a cutaway side view of an exemplary embodiment of a composite set retainer with poppet valve 200, having a plurality of PGA structural members 210. In the exemplary embodiment, cement retainer 200 is operated according to methods known in the prior art. For example, cement retainer 200 can be set on wireline or coiled tubing using conventional setting tools. Upon setting, a stinger assembly is attached to the workstring and run to retainer depth. The stinger is then inserted into the retainer bore, sealing against the mandrel inner diameter and isolating the workstring from the upper annulus.

Cement retainer 200 also includes PGA slips, which may be structurally similar to prior art iron slips, but which are molded or machined PGA according to methods disclosed herein. Teeth may be added to the tips of PGA slips 220 to aid in gripping the well casing, and may be made of iron, tungsten-carbide, or other hardened materials known in the art. In other embodiments, PGA slip may include a PGA base material with hardened buttons of ceramic, iron, tungsten-carbide, or other hardened materials embedded therein. Some embodiments of cement retainer 200 may be configured for use with a PGA frac ball 110.

Once sufficient set down weight has been established, applied pressure (cement) is pumped down the workstring, opening the one-way check valve and allowing communication beneath the cement retainer 200. Cement retainer 200 has a low metallic content and in some embodiments, may require no drilling whatsoever. Rather, cement retainer 200 is left in the well bore and PGA structural members 210 and PGA slips 220 are permitted to break down naturally. In some embodiments, the remaining metallic pieces may be sufficiently small to pump out of the well bore. In other embodiments, minimal drilling is required to clean out remaining metallic pieces.

Figure 3:
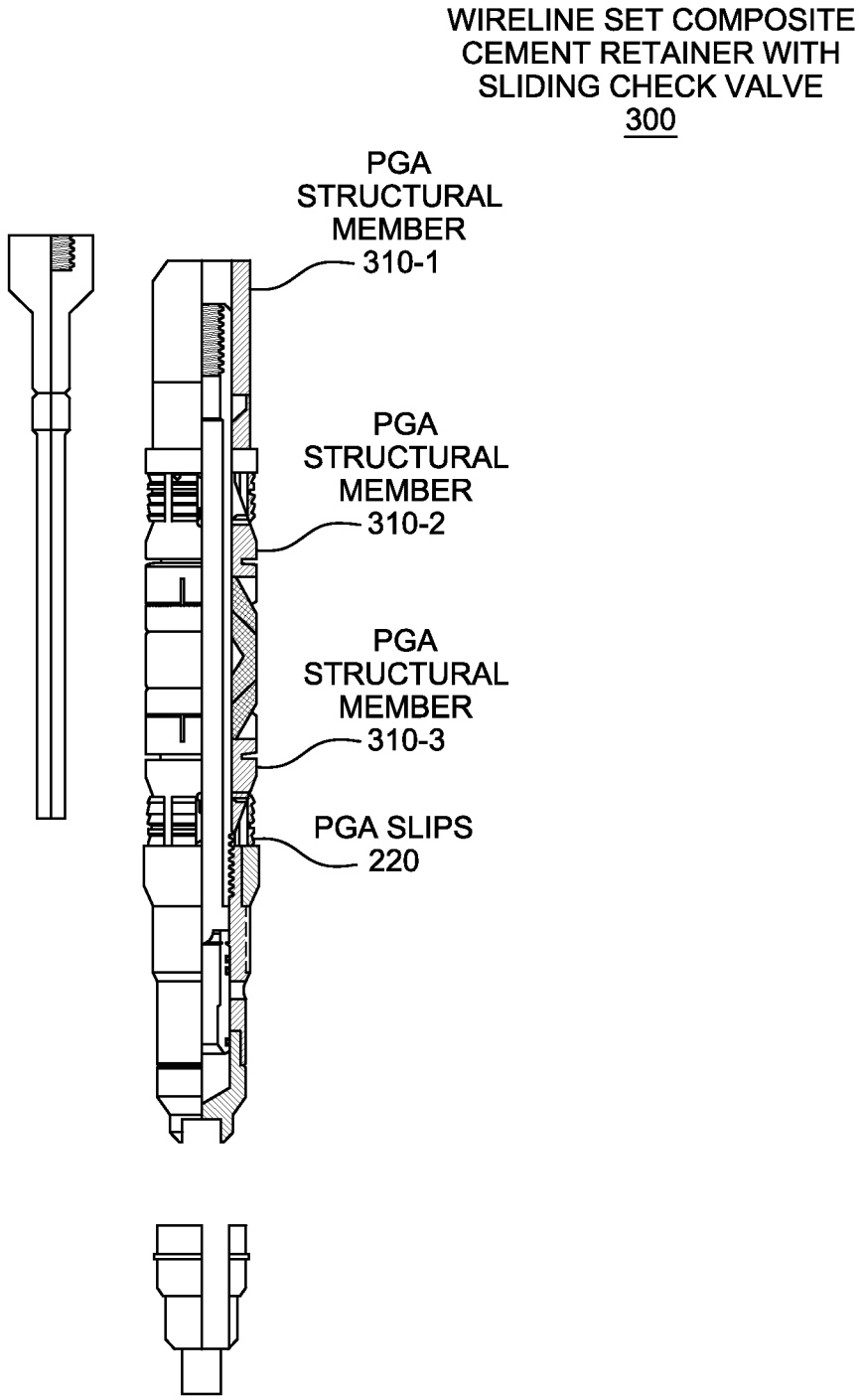
FIG. 3 is a cutaway side view of a wireline set composite cement retainer with sliding check valve, having PGA structural members.

FIG. 3 is a cutaway side view of an exemplary embodiment of a wireline set cement retainer with sliding sleeve 300. Cement retainer 300 includes a plurality of PGA structural members 310 and PGA slips 220. In an exemplary embodiment, cement retainer 300 is operated according to methods known in the prior art. For example, cement retainer 300 can be set on wireline or coiled tubing using conventional setting tools. Upon setting, a stinger assembly is attached to the workstring and run to retainer depth. The stinger is then inserted into the retainer bore, sealing against the mandrel inner diameter and isolating the workstring from the upper annulus. Once sufficient set down weight has been applied, the stinger assembly opens the lower sliding sleeve, allowing the squeeze operation to be performed.

Cement retainer 300 has a low metallic content and in some embodiments, may require no drilling whatsoever. Rather, cement retainer 300 is left in the well bore and PGA structural members 310 are permitted to break down naturally. In some embodiments, the remaining metallic pieces may be sufficiently small to pump out of the well bore. In other embodiments, minimal drilling is required to clean out remaining metallic pieces. Some embodiments of cement retainer 300 may be configured for use with a PGA frac ball 110.

Figure 4:
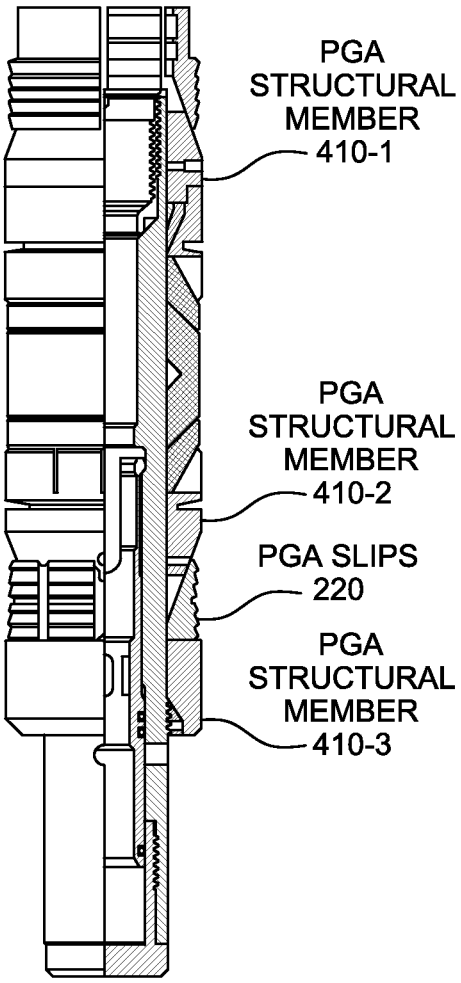
FIG. 4 is a cutaway side view of a mechanical set composite cement retainer with sliding sleeve check valve, having PGA structural members.

FIG. 4 is a cutaway side view of an exemplary embodiment of a mechanical set cement retainer with sliding sleeve check valve 400. Cement retainer 400 includes a plurality of PGA structural members 410 and PGA slips 220. In an exemplary embodiment, cement retainer 400 is operated according to methods known in the prior art. For example, cement retainer 400 can be set on tubing using conventional mechanical setting tools. Once set mechanically, an acceptable workstring weight is then set on the retainer for a more secure fit.

During the cementing operation, simple valve control can be accomplished through surface pipe manipulation, causing the hydraulic forces to either add or subtract weight to cement retainer 400. The operator should complete the hydraulic calculations to prevent overloading or pumping out of the retainer. The cementing process can then begin.

Cement retainer 400 has a low metallic content and in some embodiments, may require no drilling whatsoever. Rather, cement retainer 400 is left in the well bore and PGA structural members 410 are permitted to break down naturally. In some embodiments, the remaining metallic pieces may be sufficiently small to pump out of the well bore. In other embodiments, minimal drilling is required to clean out remaining metallic pieces. Some embodiments of cement retainer 400 may be configured for use with a PGA frac ball 110.

Figure 5:
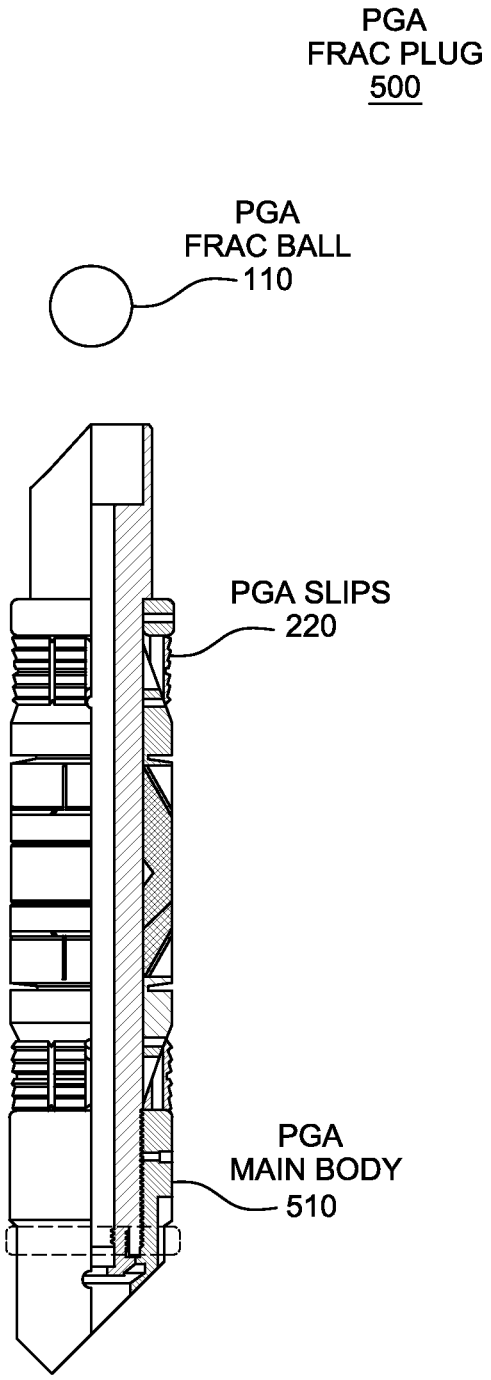
FIG. 5 is a is a cutaway side view of a PGA frac plug.

FIG. 5 is a cutaway side view of an exemplary embodiment of a PGA frac plug 500. Frac plug 500 includes a PGA main body 510, and in some embodiments may also include PGA slips 220.

In an exemplary embodiment, PGA frac plug 500 is operated according to methods known in the prior art. For example, after performing the setting procedure known in the art, frac plug 500 remains open for fluid flow and allows wireline services to continue until the ball drop isolation procedure has started. The ball drop isolation procedure may include use of a PGA frac ball 110. Once the surface-dropped ball is pumped down and seated into the inner funnel top of the tool, the operator can pressure up against the plug to achieve isolation.

Frac plug 500 has a low metallic content and in some embodiments, may require no drilling whatsoever. Rather, PGA frac plug 500 is left in the well bore and PGA main body 510 and PGA slip 520 are permitted to break down naturally. In some embodiments, the remaining metallic pieces may be sufficiently small to pump out of the well bore. In other embodiments, minimal drilling is required to clean out remaining metallic pieces. Some embodiments of frac plug 500 may be configured for use with a PGA frac ball 110.

In the prior art, frac plugs such as PGA frac plug 500 are used primarily for horizontal applications. But PGA frac plug 500's slim, lightweight design makes deployment fast and efficient in both vertical and horizontal wells.

Figure 6:
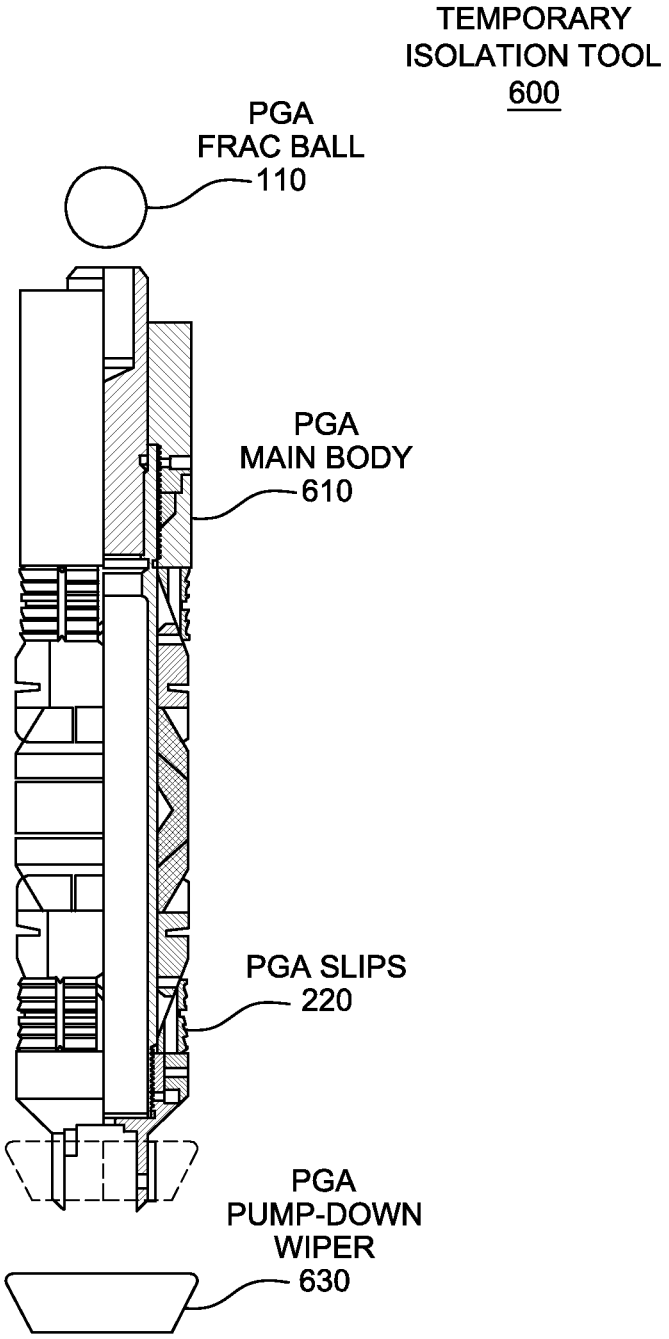
FIG. 6 is a cutaway side view of a temporary isolation tool with PGA structural members.

FIG. 6 is a cutaway side view of an exemplary embodiment of a temporary isolation tool 600, including a PGA main body 610 and PGA slips 220. In the exemplary embodiment, temporary isolation valve 600 is operated according to methods known in the prior art. In one embodiment, temporary isolation tool 600 is in a "ball drop" configuration, and PGA frac ball 620 may be used therewith. As is known in the art, temporary isolation tool 600 may be combined with three additional on-the-fly inserts (a bridge plug, a flow-back valve, or a flow-back valve with a frac ball), providing additional versatility. In some embodiments, a dissolvable PGA pump-down wiper 630 may be employed to aid in inserting temporary isolation tool 600 into horizontal well bores.

Built with a one-way check valve, temporary isolation tool 600 temporarily prevents sand from invading the upper zone and eliminates cross-flow problems for example by using a PGA frac ball 110 as a sealer. After PGA frac ball 110 has been dissolved by pressure, temperature or fluid, the check valve will allow the two zones to commingle. The operator can then independently treat or test each zone and remove flow-back plugs in an underbalanced environment in one trip.

Temporary isolation tool 600 has a low metallic content and in some embodiments, may require no drilling whatsoever. Rather, cement retainer 600 is left in the well bore and PGA structural members 610 are permitted to break down naturally. In some embodiments, the remaining metallic pieces may be sufficiently small to pump out of the well bore. In other embodiments, minimal drilling is required to clean out remaining metallic pieces.

Figure 7:
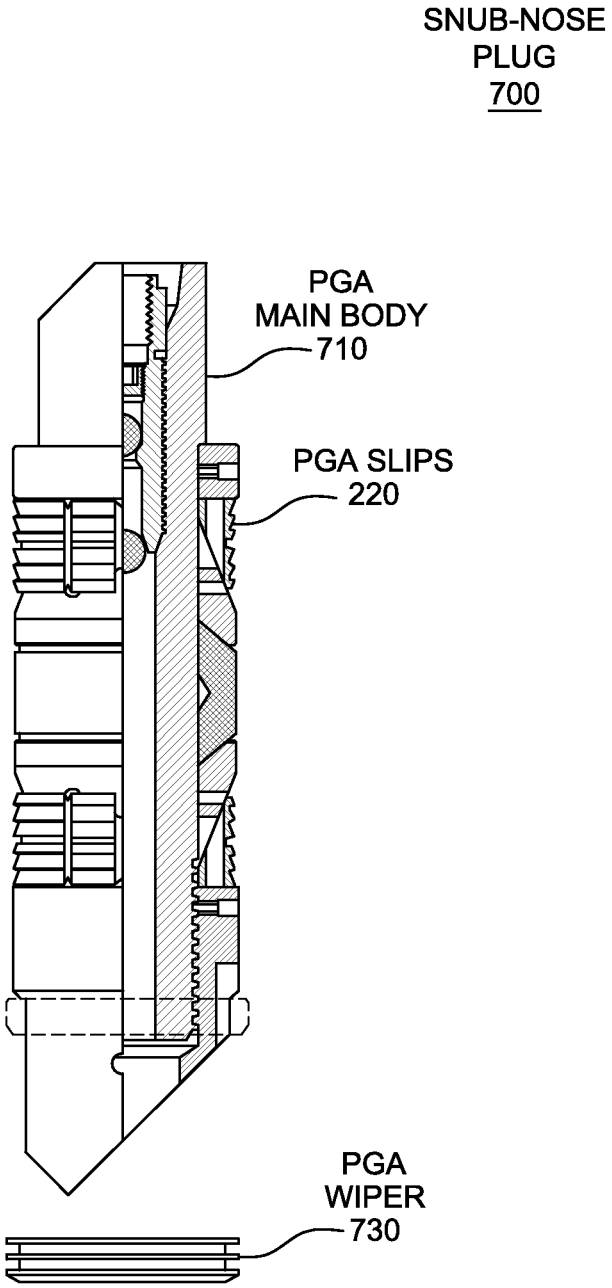
FIG. 7 is a cutaway side view of a snub nose composite plug having PGA structural members.

FIG. 7 is a cutaway side view of an exemplary embodiment of a snub nose plug 700. Sub-nose plug 700 includes a PGA main body 720, and PGA slips 220. A soluble PGA wiper 730 may be used to aid in inserting snub-nose plug 700 into horizontal well bores. In one embodiment, snub-nose plug 700 is operated according to methods known in the prior art. Dissolvable PGA wiper 730 may be used to aid insertion of snub-nose plug 700 into horizontal well bores.

Snub-nose plug 700 may be provided in several configurations with various types of valves. In one embodiment, snub-nose plug 700 may be used in conjunction with a PGA frac ball 110.

Snub-nose plug 700 has a low metallic content and in some embodiments, may require no drilling whatsoever. Rather, cement retainer 700 is left in the well bore and PGA structural members 710 are permitted to break down naturally. In some embodiments, the remaining metallic pieces may be sufficiently small to pump out of the well bore. In other embodiments, minimal drilling is required to clean out remaining metallic pieces.

Figure 8:
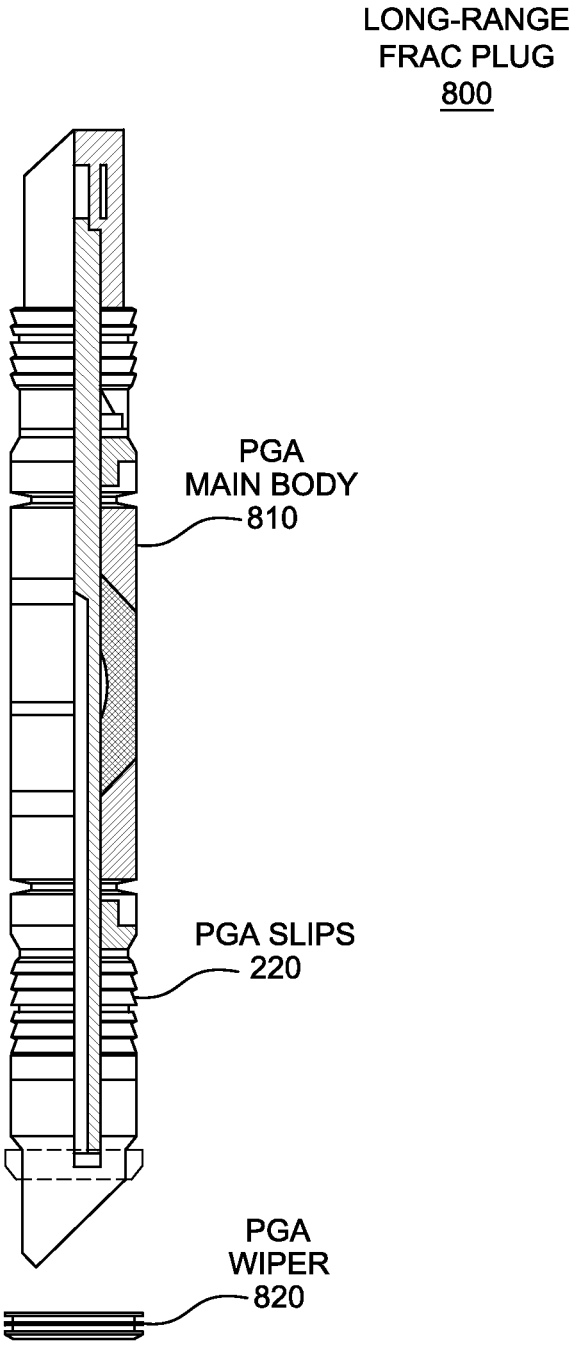
FIG. 8 is a cutaway side view of a long-range PGA frac plug.

FIG. 8 is a cutaway side view of an exemplary embodiment of long-range frac plug. In one embodiment, frac plug 810 includes a PGA body. A dissolvable PGA wiper 820 may be provided to aid in insertion into horizontal well bores. In one embodiment, long-range composite frac plug 800 is operated according to methods known in the prior art, enabling wellbore isolation in a broad range of environments and applications. Because frac plug 800 has a slim outer diameter and expansive reach, it can pass through damaged casing, restricted internal casing diameters or existing casing patches in the well bore.

When built with a one-way check valve, frac plug 800 temporarily prevents sand from invading the upper zone and eliminates cross-flow problems, in some embodiments by utilizing a PGA frac ball 110. After PGA frac ball 110 has been dissolved, the check valve will allow the two zones to commingle. The operator can then independently treat or test each zone and remove the flow-back plugs in an under-balanced environment in one trip.

Frac plug 800 has a low metallic content and in some embodiments, may require no drilling whatsoever. Rather, cement retainer 800 is left in the well bore and PGA structural members 810 are permitted to break down naturally. In some embodiments, the remaining metallic pieces may be sufficiently small to pump out of the well bore. In other embodiments, minimal drilling is required to clean out remaining metallic pieces.

Figure 9:
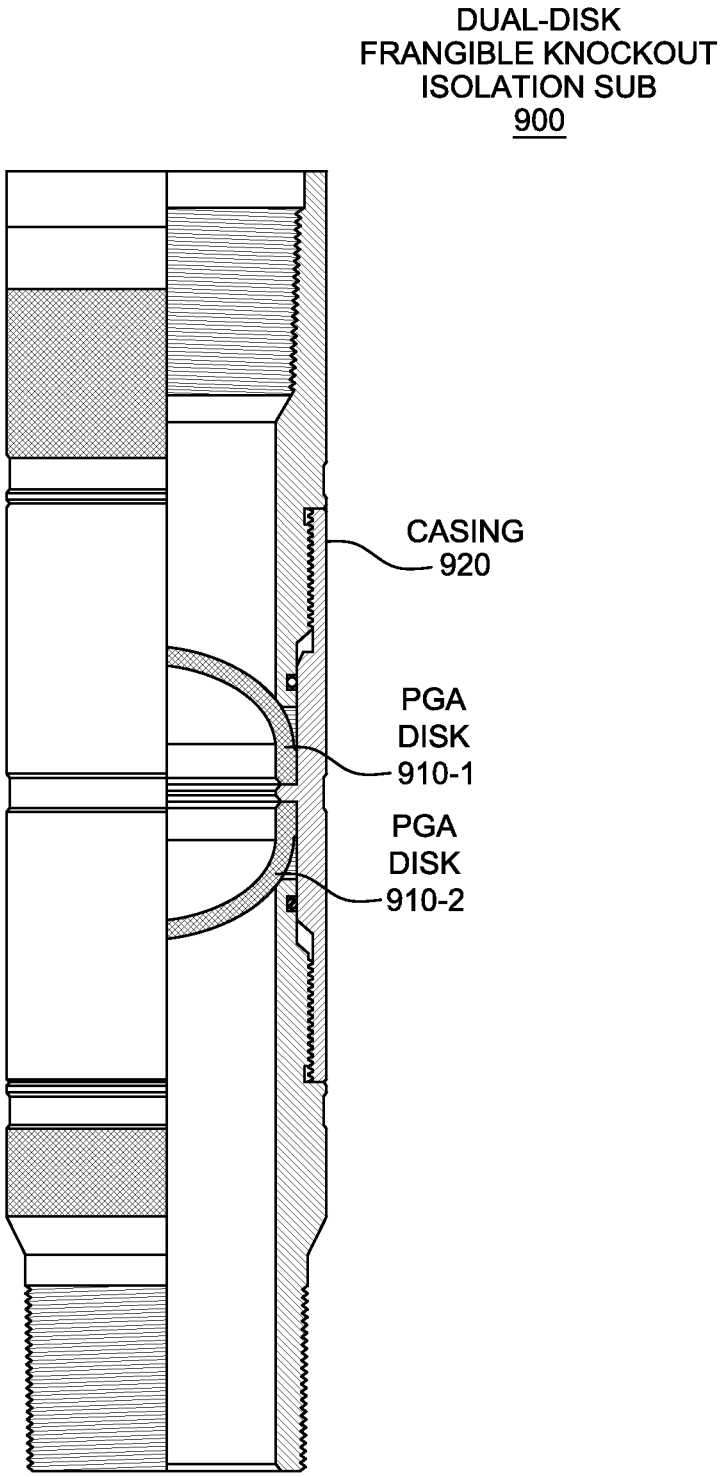
FIG. 9 is a cutaway side view of a dual disk frangible knockout isolation sub, having PGA disks.

FIG. 9 is a cutaway side view of an exemplary embodiment of a dual-disk frangible knockout isolation sub 900. In an exemplary embodiment, isolation sub 900 includes a metal casing 920 that forms part of the tubing or casing string. Isolation sub 900 is equipped with two PGA disks 910, which may be dome-shaped as shown, or which may be solid cylindrical plugs. PGA disks 910 isolate wellbore reservoir pressure in a variety of downhole conditions. In an exemplary embodiment, isolation sub 900 is operated according to methods known in the prior art.

In operation, PGA disks 910 are configured to withstand conditions such as intense heat and heavy mud loads. The isolation sub 900 is run on the bottom of the tubing or below a production packer bottom hole assembly. After the production packer is set, the disks isolate the wellbore reservoir.

After the upper production bottom hole assembly is run in hole, latched into the packer, and all tests are performed, PGA disks 910 can be knocked out using a drop bar, coil tubing, slickline or sand line, or they can be left to dissolve on their own. Once PGA disks 910 are removed, the wellbore fluids can then be produced up the production tubing or casing string. The individual PGA pieces then biodegrade in an environmentally-responsible manner.

Figure 10:
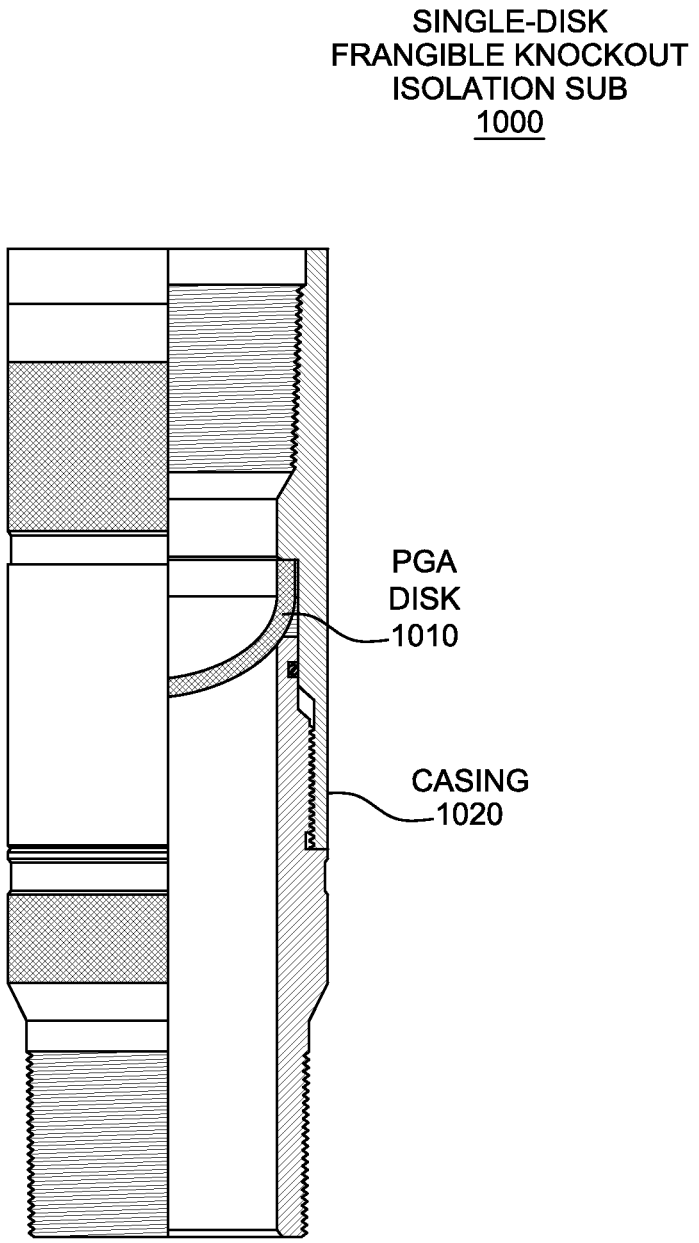
FIG. 10 is a cutaway side view of a single disk frangible knockout isolation sub.

FIG. 10 is a cutaway side view of an exemplary embodiment of a single-disk frangible knockout isolation sub. In an exemplary embodiment, isolation sub 1000 includes a metal casing 1020 that forms part of the tubing or casing string. Isolation sub 1000 is equipped with a single PGA disk 1010, which may be dome-shaped as shown or which may be a solid cylindrical plug. PGA disk 1010 isolates wellbore reservoir pressure in a variety of downhole conditions.

For both snubbing and pump-out applications, isolation sub 1000 provides an economical alternative to traditional methods. Designed to work in a variety of conditions, isolation sub 1000 provides a dependable solution for a range of isolation operations.

Isolation sub 1000 is run on the bottom of the tubing or below a production packer bottom hole assembly. Once the production packer is set, isolation sub 1000 isolates the wellbore reservoir.

After the upper production bottom hole assembly is run in hole, latched in to the packer, and all tests are performed, PGA disk 1010 can be pumped out. In an exemplary embodiment, removal comprises applying overbalance pressure from surface to pump out PGA disk 1010. In other embodiments, drop bar, coil tubing, slickline or sand line can also be used. In yet other embodiments, PGA disk 1010 is left to dissolve on its own. Once disk 1010 is removed, wellbore fluids can be produced up the production tubing.

Figure 11:
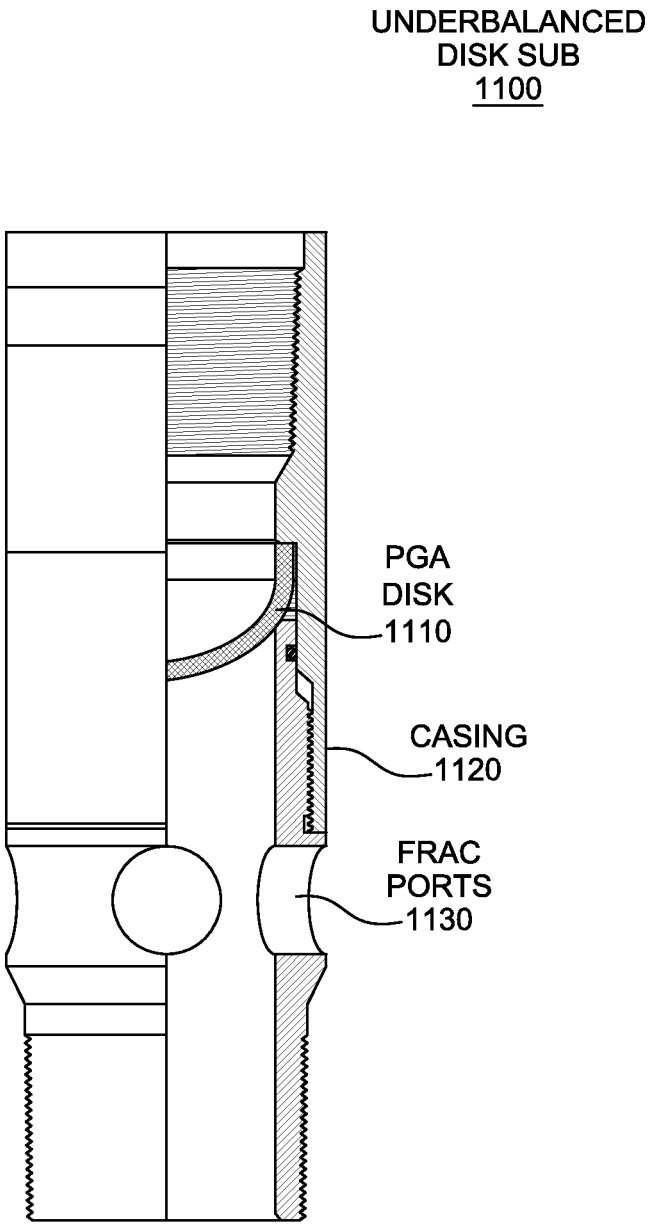
FIG. 11 is a cutaway side view of an underbalanced disk sub having a PGA disk.

FIG. 11 is a cutaway side view of an exemplary embodiment of an underbalanced disk sub 1100, including a metal casing 1120, which is part of the tubing or casing string, and production ports 1130, which provide for hydrocarbon circulation. A single PGA disk 1110 is provided for zonal isolation. In an exemplary embodiment, isolation sub 1100 is operated according to methods known in the prior art.

Figure 12:
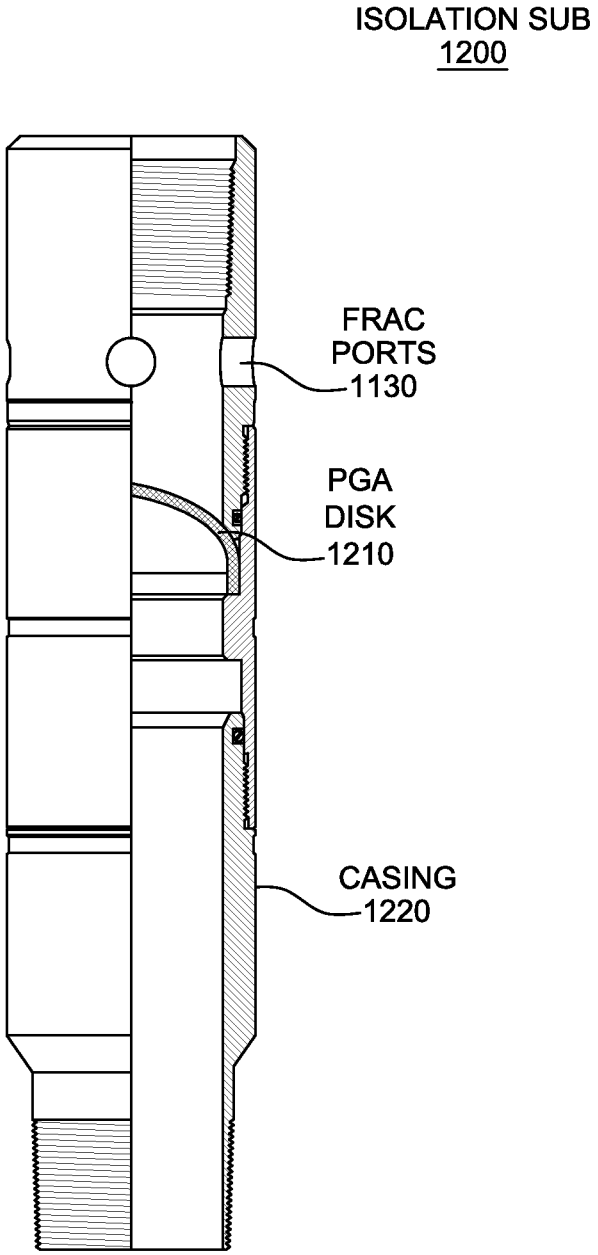
FIG. 12 is a cutaway side view of an isolation sub having a PGA disk.

FIG. 12 is a cutaway side view of an exemplary embodiment of an isolation sub 1200, including a metal casing 1220, which is part of the tubing or casing string, and ports 1230, which provide for hydrocarbon circulation. A single PGA disk 1210 is provided for zonal isolation. In an exemplary embodiment, isolation sub 1200 is operated according to methods known in the prior art.

Figure 13:
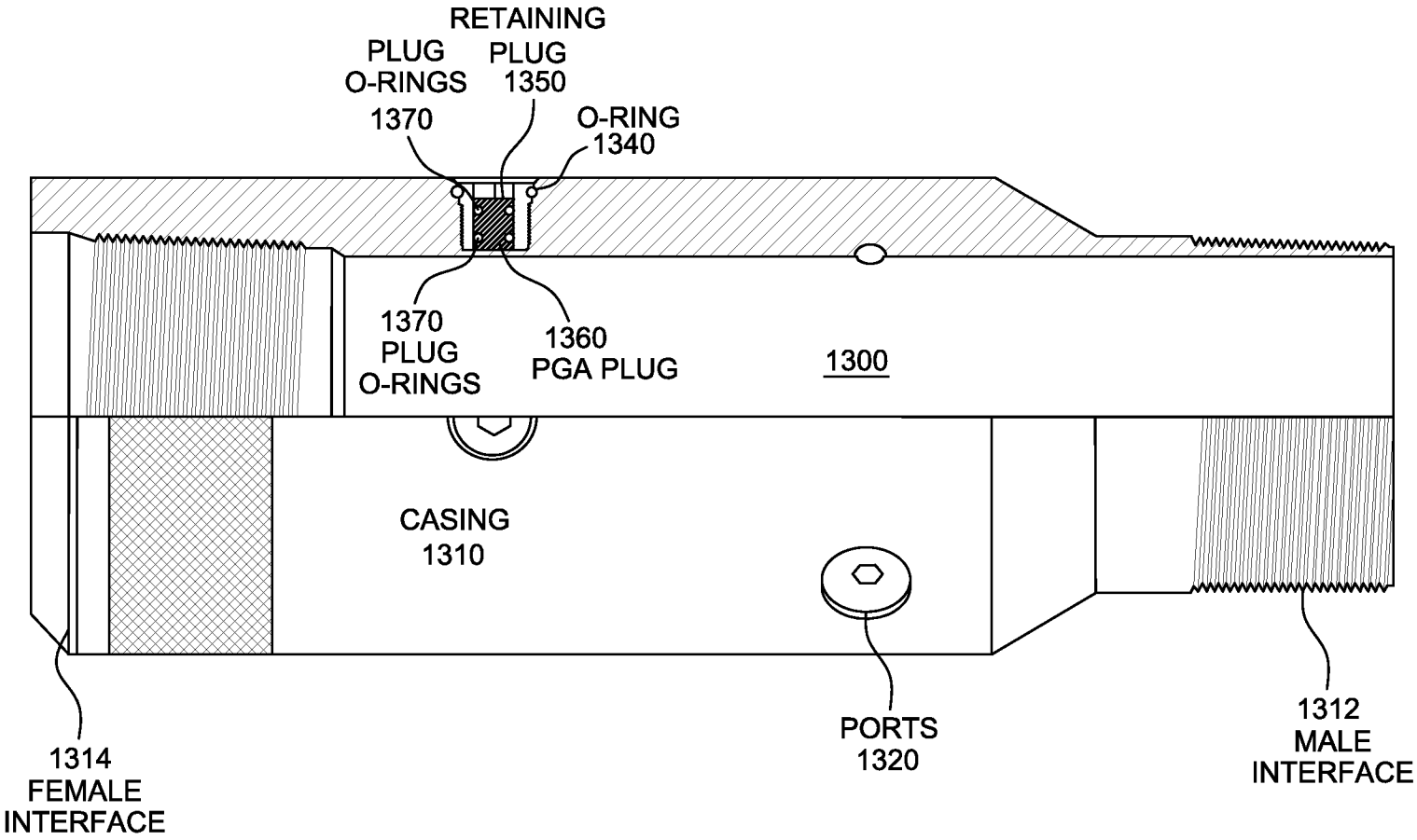
FIG. 13 is a partial cutaway view of an exemplary embodiment of a balldrop isolation sub with a PGA retaining plug.

FIGS. 13-13C are detailed views of an exemplary isolation sub. In FIG. 13, an exemplary embodiment, isolation sub 1300 is operated according to methods known in the prior art. FIG. 13 provides a partial cutaway view of isolation sub 1300 including a metal casing 1310. Casing 1310 is configured to interface with the tubing or casing string, including via female interface 1314 and male interface 1312, which permit isolation sub 1300 to threadingly engage other portions of the tubing or casing string. Disposed along the circumference of casing 1310 are a plurality of ports 1320. In operation, ports 1320 are initially plugged with a retaining plug 1350 during the fracking operation, but ports 1320 are configured to open so that hydrocarbons can circulate through ports 1350 once production begins. Retaining plug 1350 is sealed with an O-ring 1340 and threadingly engages a port void 1380 (FIG. 13A). Sealed within retaining plug 1350 is a PGA plug 1360, sealed in part by plug O-rings 1370.

FIG. 13A is a cutaway side view of isolation sub. Shown particularly in this figure are bisecting lines A-A and B-B. Disposed around the circumference of casing 1310 are a plurality of port voids 1380, which fluidly communicate with the interior of casing 1310. Port voids 1380 are configured to threadingly receive retaining plugs 1350. A detail of port void 1380 is also included in this figure. As seen in sections A-A and B-B, two courses of port voids 1380 are included. The first course, including port voids 1380-1, 1380-2, 1380-3, and 1380-4 are disposed at substantially equal distances around the circumference of casing 1310. The second course, including port voids 1380-5, 1380-6, 1380-7, and 1380-8 are also disposed at substantially equal distances around the circumference of casing 1310 and are offset from the first course by approximately forty-five degrees.

FIG. 13B contains a more detailed side view of PGA plug 1360. In an exemplary embodiment, PGA plug 1360 is made of machined, solid-state high-molecular weight polyglycolic acid. In other embodiments, PGA plug 1360 may be machined. The total circumference of PGA plug 1360 may be approximately 0.490 inches. Two O-ring grooves 1362 are included, with an exemplary width between 0.093 and 0.098 inches each, and an exemplary depth of approximately 0.1 inches.

FIG. 13C contains a more detailed side view of a retaining plug 1350. Retaining plug 1350 includes a screw head to aid in mechanical insertion of retaining plug 1350 into port void 1380 (FIG. 13A). Retaining plug 1350 also includes threading 1356, which permits retaining plug 1350 to threadingly engage port void 1380. An O-ring groove 1352 is included to enable plug aperture 1358 to securely seal into port void 1380. A plug aperture 1358 is also included to securely receive a PGA plug 1360. In operation, isolation sub 1300 is installed in a well casing or tubing. After the fracking operation is complete, PGA plugs 1360 will break down in the pressure and temperature environment of the well, opening ports 1320. This will enable hydrocarbons to circulate through ports 1320.

Figure 14:
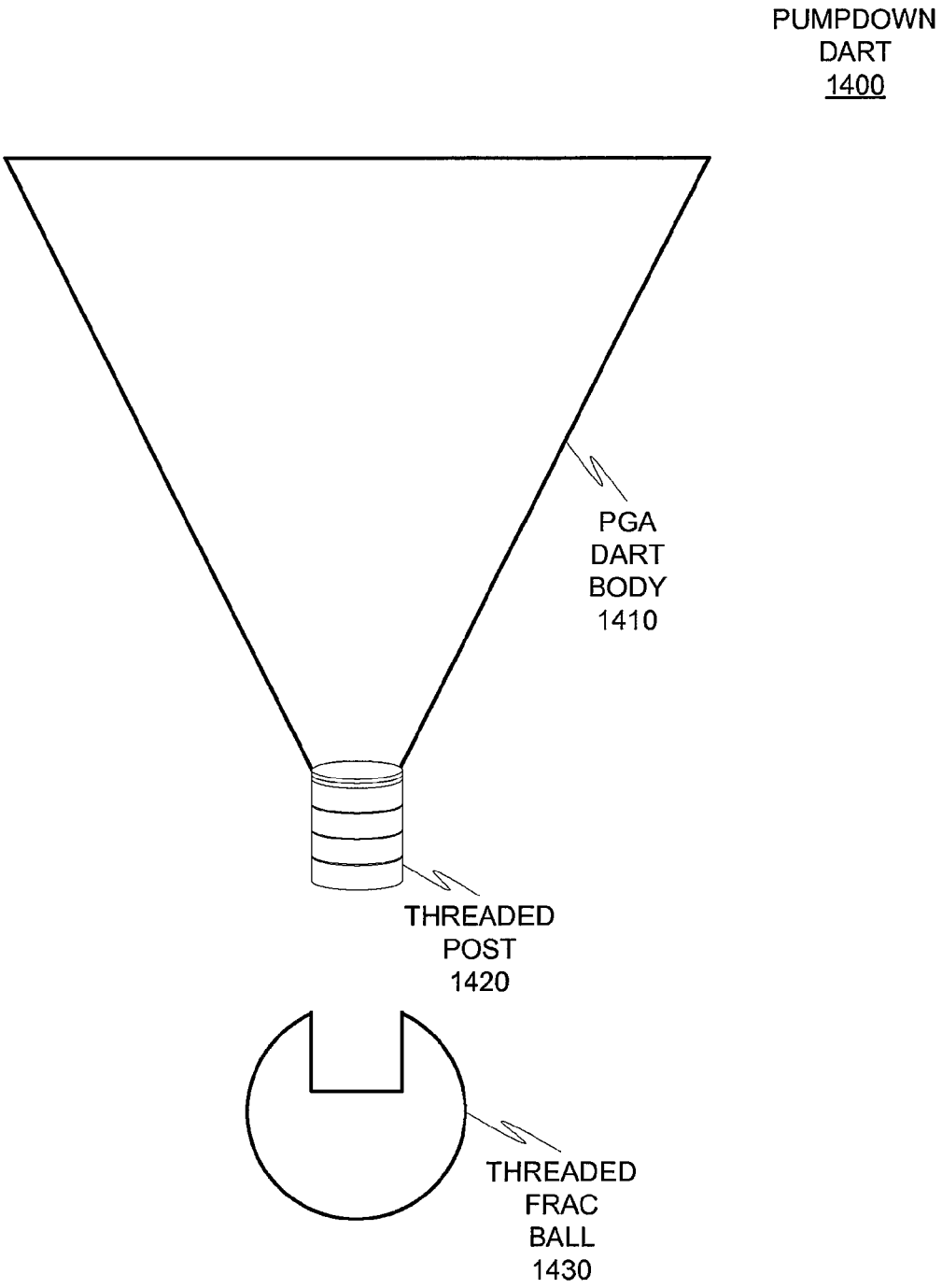
FIG. 14 is a cutaway side view of a PGA pumpdown dart.

FIG. 14 is a side view of an exemplary embodiment of a pumpdown dart 1400. In an exemplary embodiment, pumpdown dart 1400 is operated according to methods known in the prior art. In particular, pumpdown dart 1400 may be used in horizontal drilling applications to properly insert tools that may otherwise not properly proceed through the casing. Pumpdown dart 1400 includes a PGA dart body 1410, which is a semi-rigid body configured to fit tightly within the casing. In some embodiments, a threaded post 1420 is also provided, which optionally may also be made of PGA material. Some applications for threaded post 1420 are known in the art. In some embodiments, threaded post 1420 may also be configured to interface with a threaded frac ball 1430. Pumpdown dart 1400 may be used particularly in horizontal drilling operations to ensure that threaded frac ball 1430 does not snag or otherwise become obstructed, so that it can ultimately properly set in a valve seat.

Advantageously, pumpdown dart 1400 permits threaded frac ball 1410 to be seated with substantially less pressure and fluid than is required to seat PGA frac ball 110.

While the subject of this specification has been described in connection with one or more exemplary embodiments, it is not intended to limit the claims to the particular forms set forth. On the contrary, the appended claims are intended to cover such alternatives, modifications and equivalents as may be included within their spirit and scope.

The invention claimed is:

1. A method of recovering hydrocarbons with a solid-state dissolvable tool, namely a frac ball operated bridge plug, comprising:

inserting the bridge plug into a well bore, the bridge plug containing a primary structural member, namely a mandrel, the mandrel consisting essentially of high-molecular weight polyglycolic acid, namely Kuredux or its substantial equivalent, which is suitable for a high-pressure downhole fracking operation, has at least short-term stability in ambient conditions, and which is capable of losing crystalline structure due to hydrolysis in the wellbore under thermal stress of 250° F., and thereafter degrades in the wellbore into naturally-occurring glycerin, the bridge plug having a ball seat;

pumping the bridge plug down the well bore from the surface with a pumping fluid which does not have an appreciable effect on the short-term structural integrity of the bridge plug;

setting the bridge plug in the wellbore;

pumping the frac ball, consisting essentially of solid-state high-molecular weight polyglycolic acid, namely Kuredux or its substantial equivalent, down the well bore from the surface with a pumping fluid which does not have an appreciable effect on the short-term structural integrity of the frac ball to seat the frac ball securely into the ball seat, the frac ball seated in the ball seat isolating a wellbore zone above the bridge plug from a wellbore zone below the bridge plug, allowing the zone above the bridge plug to be fracked in isolation from the zone below the bridge plug;

fracturing the zone above the bridge plug;

allowing the frac ball to lose sufficient crystalline structure due to hydrolysis within less than approximately 48 hours to pass through the ball seat, causing the bridge plug and frac ball combination to cease isolating upper and lower zones from each other without drilling out the bridge plug or other intervention from the surface; and allowing the bridge plug to degrade through hydrolysis into products which are not harmful to the environment without drilling out the bridge plug or other intervention from the surface, one of the degradation products being glycerin.

2. The method of claim 1 wherein the mandrel, ball seat and frac ball are each comprised of machined solid-state Kuredux grade 100R60 or its substantial equivalent and the bridge plug releases from the wellbore within 48 hours of insertion into the wellbore due to loss of crystalline structure causing mechanical failure of the bridge plug.

3. The method of claim 2 wherein the bridge plug includes slips comprised of solid-state Kuredux grade 100R60 or its substantial equivalent, including at least a base material comprised of solid-state Kuredux grade 100R60 or its substantial equivalent.

4. A method of recovering subterranean resources comprising:

drilling a well bore;

inserting into a well bore a solid-state mechanical dissolvable tool, namely a bridge plug, containing a primary structural member, namely a mandrel, consisting essentially of a machined high-molecular weight polyglycolic acid, namely Kuredux or its substantial equivalent;

operating the tool to temporarily isolate a zone above the tool from a zone below the tool; and allowing the primary structural member to substantially degrade through hydrolysis into products which are not harmful to the environment without drilling it out or other intervention from the surface, one of the degradation products being glycerin.

5. The method of claim 4 wherein the high-molecular weight polyglycolic acid is Kuredux grade 100R60 or its substantial equivalent.

6. A frac ball for seating in a ball seat of a bridge plug, the frac ball having a substantially spherical shape, a diameter between 0.75 inches and 4.625 inches, consisting essentially of machined high-molecular weight polyglycolic acid, namely Kuredux grade 100R60 or its substantial equivalent, the frac ball being capable of being pumped down a well bore from the surface with a pumping fluid without an appreciable effect on a short-term structural integrity of the frac ball, to seat securely into a ball seat of a bridge plug, isolating a zone in the well above the bridge plug from a zone in the well below the bridge plug, facilitating fracturing the zone above the bridge plug; the frac ball being capable of losing sufficient crystalline structure due to hydrolysis within less than approximately 48 hours to pass through the ball seat, causing the bridge plug and frac ball combination to cease isolating upper and lower zones from each other without drilling out the bridge plug or other intervention from the surface.

7. A mineral recovery tool , namely a frac ball operated bridge plug, for use in a well bore, comprising:

a primary structural member, namely a mandrel, consisting essentially of machined solid-state high-molecular-weight polyglycolic acid; namely Kuredux or its substantial equivalent, which has at least short-term stability in ambient conditions and loses sufficient crystalline structure due to hydrolysis in the wellbore under thermal stress of 250° F. to mechanically fail within approximately 48 hours and thereafter degrading in the wellbore into naturally-occurring glycerin, the bridge plug having a ball seat;

the ball seat comprised of solid-state high-molecular-weight polyglycolic acid;

a frac ball comprised of solid-state high-molecular-weight polyglycolic acid; namely Kuredux or its substantial equivalent, capable of being pumped down the well bore from the surface with a pumping fluid which does not have an appreciable effect on the short-term structural integrity of the frac ball, to seat securely into the ball seat;

wherein the frac ball has sufficient crystalline structure to be capable of causing the bridge plug and frac ball to isolate a zone in the wellbore above the bridge plug from a zone in the wellbore below the bridge plug so the zone above the bridge plug can be fracked in isolation from the zone below the bridge plug, and the frac ball is capable of losing sufficient crystalline structure due to hydrolysis within less than approximately 48 hours from being pumped down the wellbore to pass through the ball seat, causing the bridge plug and frac ball combination to cease isolating upper and lower zones from each other without drilling out the bridge plug or other intervention from the surface; and the bridge plug is capable of degrading in the wellbore through hydrolysis into products which are not harmful to the environment without drilling out the bridge plug or other intervention from the surface, one of the products being glycerin.

8. The tool of claim 7 wherein mandrel, ball seat and frac ball are each comprised of Kuredux grade 100R60 or its substantial equivalent and the bridge plug releases from the wellbore within 48 hours of insertion into the wellbore due to loss of crystalline structure causing mechanical failure of the bridge plug.

9. The tool of claim 7 further comprising slips, each slip comprised of a base consisting essentially of Kuredux grade 100R60 or its substantial equivalent, and hard teeth made of hard and materials for gripping the well casing.

* * * * *